US006704939B2

(12) United States Patent
Faulconer

(10) Patent No.: US 6,704,939 B2
(45) Date of Patent: Mar. 16, 2004

(54) GLOVE WITH PALM GRIPS

(75) Inventor: Mark Faulconer, Newport Beach, CA (US)

(73) Assignee: McCrane, Inc., Napa, CA (US)

( * ) Notice: Subject to any disclaimer, the term of this patent is extended or adjusted under 35 U.S.C. 154(b) by 64 days.

(21) Appl. No.: 10/007,610

(22) Filed: Nov. 30, 2001

(65) Prior Publication Data

US 2003/0000005 A1 Jan. 2, 2003

Related U.S. Application Data

(60) Provisional application No. 60/299,373, filed on Jun. 19, 2001.

(51) Int. Cl.[7] ..... A41D 19/00
(52) U.S. Cl. ..... 2/161.1; 2/20
(58) Field of Search ..... 2/16, 20, 159, 2/160, 161.1, 161.2, 161.3, 161.6, 163, 164, 169, 243.1, 267, 275

(56) References Cited

U.S. PATENT DOCUMENTS 3,863,271 A * 2/1975 Moroney ..... 2/161.2
4,691,387 A * 9/1987 Lopez ..... 2/161.3
4,747,163 A * 5/1988 Dzierson ..... 2/161.1
5,214,799 A * 6/1993 Fabry ..... 2/161.6
5,257,418 A * 11/1993 Jaskiewicz ..... 2/20
5,345,609 A * 9/1994 Fabry et al. ..... 2/20
5,581,809 A * 12/1996 Mah ..... 2/20
5,603,118 A * 2/1997 Solomon ..... 2/20
5,675,839 A * 10/1997 Gordon et al. ..... 2/159
5,790,980 A * 8/1998 Yewer, Jr. ..... 2/20
5,855,022 A * 1/1999 Storto ..... 2/161.2

* cited by examiner

*Primary Examiner*—Gary L. Welch
(74) *Attorney, Agent, or Firm*—Richard E. Backus

(57) ABSTRACT

A glove for wearing on a user's hand to grip an object, such as a barbell. The glove has a palm side which carries a plurality of pads that have gripping surfaces. The pads are positioned in spaced-apart relationship and connected together by a flexible connecting layer. The connecting layer is sufficiently thinner than the pads to allow the glove and user's hand to be comfortably curled about and uncurled from a object while enabling a secure grip. Valleys between the pads serve to recess the connecting layer below the gripping surfaces.

13 Claims, 3 Drawing Sheets

GLOVE WITH PALM GRIPS

CROSS-REFERENCE TO PRIOR APPLICATION

This application claims the benefit under 35 USC §119(e) of United States provisional application serial no. 60/299,373 filed Jun. 19, 2001.

BACKGROUND OF THE INVENTION

1. Field of the Invention

This invention relates in general to gloves for use in sports and other activities in which a person grips an object, and more particularly to gloves for enabling a person to grip and securly hold an object such as a weighlifting barbell, oar or paddle for a boat, baseball bat, skateboard, golf club, javelin, trapeze or gymnastic bar and the like.

2. Description of the Related Art

Heretofore, people involved in activities where grip on an object is important, such as weightlifting, baseball, golf, skateboarding, paddling, gymnastics and the like, use gloves to protect their hands and improve traction with the object. Certain types of these prior gloves have palm portions which are designed to improve the grip and prevent slippage. Gloves with palm portions which are padded have been provided, but the padding can make it difficult for the person to easily and comfortably close and maintain a firm grip about the object. In prior gloves which have sufficient padding for protecting the user's hands, the palm portion tends to bunch up as the hands curl about the object. This undesirably reduces the amount of traction between the glove and object.

The need has therefore been recognized for a glove for use in gripping objects such as barbells which obviates the foregoing and other limitations and disadvantages of prior art gloves. Despite the various gloves in the prior art, there has heretofore not been provided a suitable and attractive solution to these problems.

DESCRIPTION OF THE PREFERRED EMBODIMENTS

Figure 1:
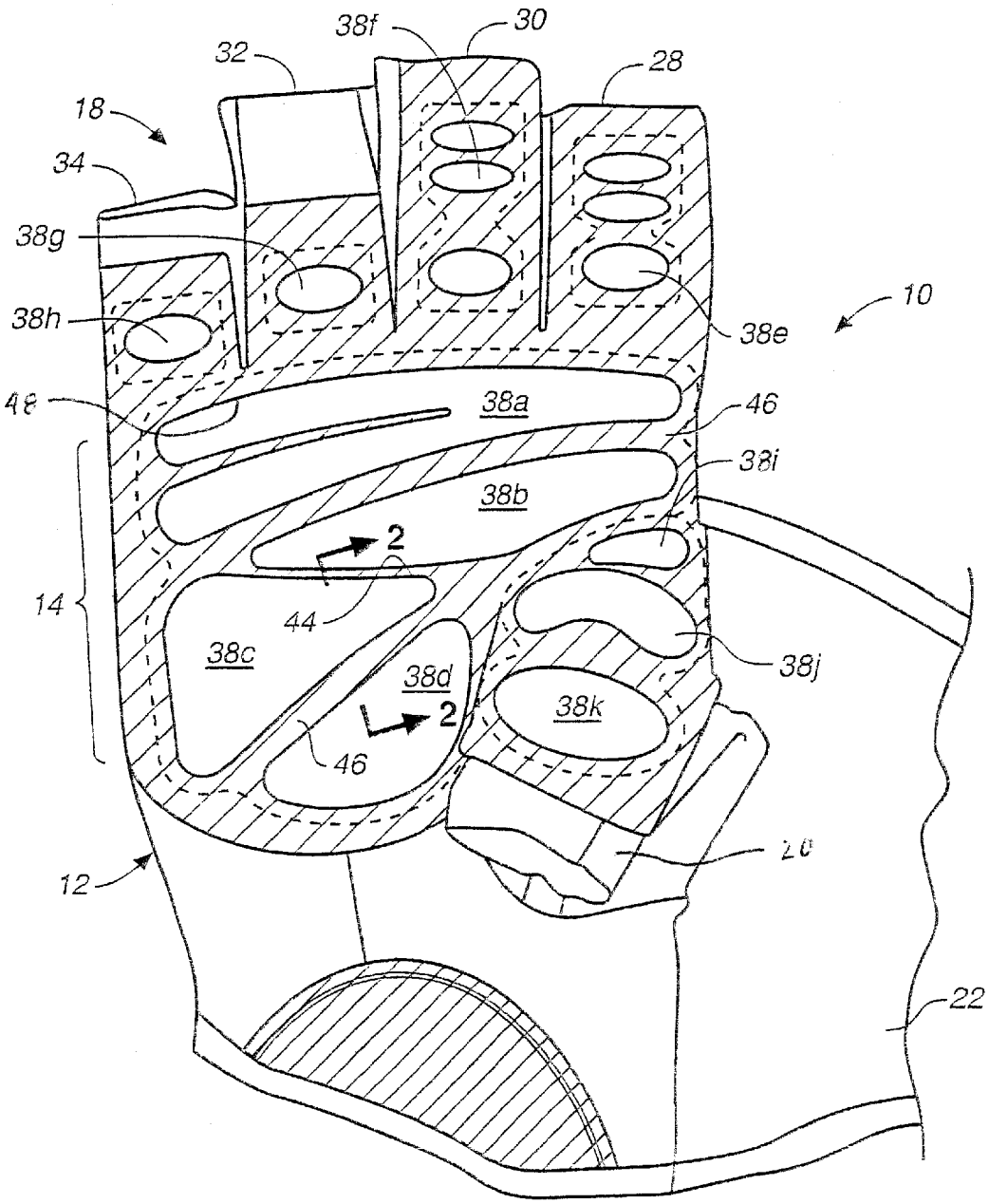
FIG. 1 is a plan view of the palm side of a glove in accordance with one embodiment of the invention.

FIG. 1 in the drawing shows generally at 10 a sports glove in accordance with one preferred embodiment of the invention. Glove 10 is comprised of a glove body 12 having a palm side comprising a palm portion 14 which includes finger stall portion 18 and thumb stall 20. The glove further comprises a back side 16 (shown in FIGS. 4A and 4B). As desired, an elongated strap 22 (only the proximal end is shown) could be attached at its proximal end to the glove body with suitable releasable attachment means (for example, Velcro® fasteners) on the strap's distal end. In use for sports such as weightlifting or skateboarding, strap 22 would be tightly wrapped around the athlete's wrist to protect against hyperflexion of the wrist.

Figure 2:
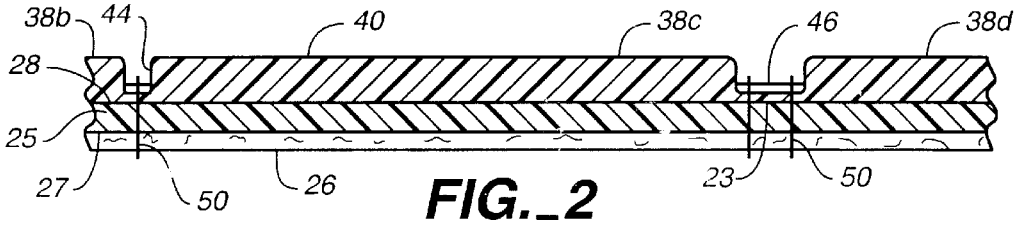
FIG. 2 is a fragmentary cross-section view to an enlarged scale taken along the line 2—2 of FIG. 1.

Glove body 12 is comprised of a connecting layer 23 integral with a plurality of gripping pads 38, an intermediate layer 25 and an optional inner lining 26. Intermediate layer 25, best shown in FIG. 2, is comprised of a suitable strong and flexible material such as leather. This layer 25 has an inside 27 which faces the hand when the glove is worn, and an outside 28 which faces away from the hand. Inner lining 26 is comprised of a thin fabric material, such as polyester, which is secured as by sewing or laminating to the inside of layer 25. This inner lining is in contact with the user's hand. It provides comfort for the hand and also serves to wick any moisture away from the skin.

Finger stall portion 18 comprises four stalls: an index finger stall 28, middle finger stall 30, ring finger stall 32 and little finger stall 34.

Gripping pads 38 are carried on palm portion 14, including the finger and thumb stalls, on their sides facing away from back side 16. The pads are raised above the connecting layer and are formed with substantially flat lands 40 which provide traction or gripping surfaces. In the drawing figures, the pads on the palm portion are labelled 38*a* through 38*d*, those on the finger stalls are labelled 38*e* through 38*h* and those on the thumb stall are labelled 38*i* through 38*k*.

The pads and connecting layer preferably are integrally formed of the same material. To this end, the connecting layer including the pads can be molded together from a suitable elastomer, such as rubber, which is flexible while providing optimum traction contact with the object being gripped. The connecting layer has a thickness which is sufficiently thinner than the pad thicknesses to enable the pads to bend toward and away from one another as the user curls and uncurls, respectively, the glove. For this purpose, a pad thickness in the range of 2 mm to 5 mm and a connecting layer thickness in the range of 0.8 mm to 2 mm can be employed.

The gripping pads 38 and connecting layer 23 can be molded by suitable processes such as injection or compression molding.

The palm portion as well as the finger and thumb stalls further comprise a stitching layer 46 which is formed with openings or windows 48 through which the gripping pads project. Layer 46 is also shaped to repose in valleys 44 which are formed between lands 40 of the gripping pads, as shown in FIG. 2. Individual ones of the openings 48 are commensurate in size and shape with the respective pads which they surround. Windows 48 can advantageously be formed by die cutting. Stitching layer 46 is formed of a suitable flexible material, such as leather, which is sufficiently strong to receive and hold stitches 50 (FIG. 2). Layer 46 enables the stitches to penetrate through the connecting layer and into intermediate layer 25 to securely anchor these components together. This construction also enables sewing below the pad surfaces so that the stitches are protected from objectionable abrasion, such as knurling on the object.

Figure 3:
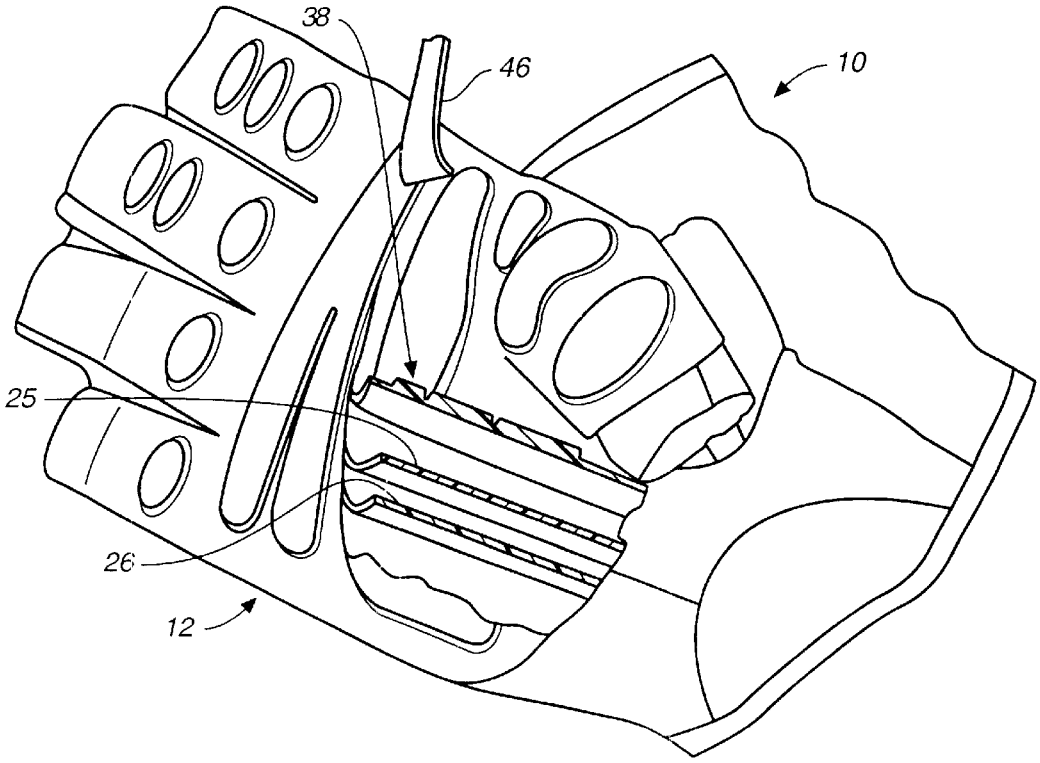
FIG. 3 is a partially cut-away isometric view of the glove shown in FIG. 1.

For purposes of clarity in the explanation, in FIG. 3 portions of intermediate layer 25, inner inner 26, pad 38 and stitching layer 46 are show partially cut-away and peeled back from the glove body.

Figure 4A:
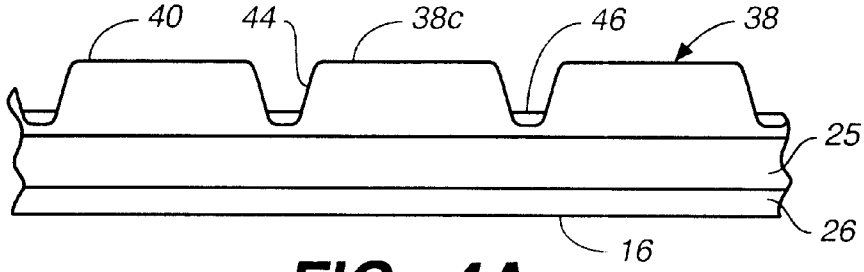
FIG. 4A is a fragmentary, side elevation view showing portions of the glove body with the palm portion uncurled.

Gripping pads 38 in combination with connecting layer 23 provide a "living hinge" action. This action is a result of the flexibility of the connecting layer together with the spacing provided by lands 40 and the relative size, shape and positioning of the pads. The living hinge enables the pads to lie spaced-apart when the glove is uncurled as shown in FIG. 4A, and then to pivot together in the manner of a hinge as the glove is curled to the configuration shown in FIG. 4B.

The gripping pads 38 are sized, shaped and positioned such that each pad essentially is an extension of the part of the human hand which it overlies. Thus, the pads 38*a*–38*d* in the glove palm portion are sized and shaped substantially commensurate with the corresponding fleshier parts of the human palm. The sizing, shaping and positioning also are such that the lands between the pads run along and essentially conform with and mimic the creases of the human palm (which act as hinges for portions of the human palm). The pads 38*e*–38*h* on the finger stalls and the lands which separate them, as well as the pads and lands for the thumb stall, are also sized, shaped and positioned substantially commensurate with the corresponding portions of the human fingers and thumb. As a result, when the glove palm is curled or uncurled then each of the pads, enabled by the glove's living hinge action, pivot with the underlying curling or uncurling portion of the person's hand, fingers and thumb.

Figure 4B:
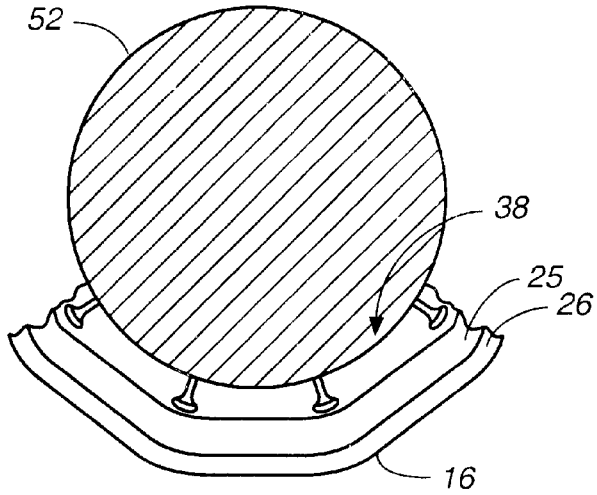
FIG. 4B is a view similar to FIG. 4A showing the palm portion curled about an object.

When a person wearing one or a pair of the sports glove 10 flexes his or her hands or grips an object, the living hinge action enables the pads to form a relatively large traction area with an almost continuous gripping surface around the object 52, shown in FIG. 4B as a barbell. This enhances the gripping effect between the glove and object.

Another embodiment of the invention provides a glove similar to the embodiment of FIGS. 1–4 and in which the palm and finger/thumb stalls are pre-curved. The glove can be pre-curved by making the connecting layer 23 on the glove's back side longer than intermediate layer 25 on the palm side, and then attaching suitable gussets (not shown) which are positioned to urge the glove into a cylindrically curved shape for gripping an object. The gussets could be comprised of pieces of triangular-shaped fabric.

Figure 5:
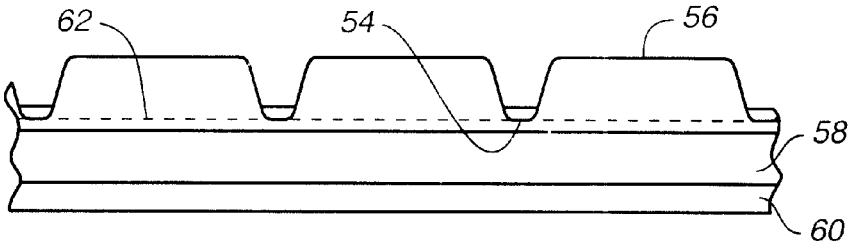
FIG. 5 is a view similar to FIG. 4A to an enlarged scale showing another embodiment providing a thinner connecting layer with a strengthing scrim or mesh integrated with the connecting layer.

A further embodiment of the invention shown in FIG. 5 provides a glove body similar to FIG. 4A but with a more flexible connecting layer 54 which is integral with and holding pads 56 apart. Layer 54 is supported on an intermediate layer 58 and optional inner layer 60. Connecting layer 54 is made with a thickness thinner than 0.8 mm to provide greater flexibility for enabling the curling action. The connecting layer and pads are strengthened by laminating or embedding or otherwise substantally integrating a suitable scrim or mesh fabric 62 into the elastomer which forms the connecting layer and pads during the molding process.

What is claimed is:

1. A glove for wearing on a user's hand for enabling the glove and hand to be comfortably curled about an object with a secure grip, the glove comprising the combination of a glove body for fitting about the hand, the body comprising a palm side, first and second pads positioned in spaced-apart relationship on the palm side, each pad having a first thickness and a substantially flat land, the glove being devoid of a cover over the lands so that the lands are enabled to directly contact the object, a gap between the pads, a flexible connecting layer in the gap, the layer being connected between the first and second pads, and the connecting layer having a second thickness which is sufficiently thinner than the first thickness and with the gap being sufficiently small so that the first and second pads are enabled to bend toward and away from contact with each other when the glove and hand curl about or uncurl from the object.

2. A glove as in claim 1 and further characterized in that the palm side comprises an intermediate layer having an inside which faces the hand and an outside which faces away from the hand and the pads are positioned on the outside of the intermediate layer.

3. A glove as in claim 1 and further characterized in that the pads are integrally formed with the connecting layer.

4. A glove as in claim 1 and further characterized in that the pads have a gripping surface for contacting the object.

5. A glove as in claim 4 and further characterized in that the first pad is separated from the second pad by a valley which is recessed below the gripping surface, and the connecting layer is seated in the valley below the gripping surface.

6. A glove as in claim 5 and further characterized in that the body comprises a stitching layer seated in the valley, the stitching layer having first and second openings through which the respective first and second pads protrude, and a plurality of stitches extending through and securing together the stitching layer with the connecting layer.

7. A glove as in claim 1 and further characterized in that the body comprises a stitching layer having a plurality of openings through which respective ones of the pads protrude, and a plurality of stitches which penetrate through and secure together the stitching layer and the connecting layer.

8. A glove as in claim 7 and further characterized in that the palm side comprises an intermediate layer having a side against which the connecting layer is positioned, and the plurality of stitches extend through the intermediate layer.

9. A glove as in claim 1 and further characterized in that the glove body comprises a finger stall, the palm side comprises one side of the finger stall, and the pads are positioned in spaced-apart relationship on the one side of the finger stall.

10. A glove as in claim 1 and further characterized in that the palm side comprises a first and second portions, the first portion facing the user's palm when the glove is being worn, the second portion comprises a finger stall, the first and second pads are positioned on the first portion, and third and fourth pads are positioned on the finger stall.

11. A glove as in claim 1 and further characterized in that the palm side comprises a first and second portions, the first portion facing the user's palm when the glove is being worn, the second portion comprises a thumb stall, the first and second pads are positioned on the first portion, and third and fourth pads are positioned on the thumb stall.

12. A glove as in claim 1 and further characterized in that a mesh of a strengthening fabric is integrated with the connecting layer.

13. A glove as in claim 1 and further characterized in that the body has an inner layer which faces the hand when the glove is worn on the hand.

* * * * *